US007283106B2

(12) United States Patent
Allen et al.

(10) Patent No.: US 7,283,106 B2
(45) **Date of Patent: *Oct. 16, 2007**

(54) TIME-LAPSING MIRROR

(75) Inventors: Paul G. Allen, Seattle, WA (US); Edward K. Y. Jung, Bellevue, WA (US); Royce A. Levien, Lexington, MA (US); Mark A. Malamud, Seattle, WA (US); John D. Rinaldo, Jr., Bellevue, WA (US)

(73) Assignee: Searete, LLC, Bellevue, WA (US)

( * ) Notice: Subject to any disclaimer, the term of this patent is extended or adjusted under 35 U.S.C. 154(b) by 45 days.

This patent is subject to a terminal disclaimer.

(21) Appl. No.: 10/910,421

(22) Filed: Aug. 2, 2004

(65) Prior Publication Data

US 2006/0022938 A1 Feb. 2, 2006

(51) Int. Cl.
*G09G 3/00* (2006.01)

(52) U.S. Cl. ..... 345/32; 345/156

(58) Field of Classification Search ..... 345/8, 345/156, 32; 132/301; 382/154; 2/209.14; 434/371; D28/64.1; D03/275
See application file for complete search history.

(56) References Cited

U.S. PATENT DOCUMENTS

| | | | |
|---|---|---|---|
| 3,838,525 | A | 10/1974 | Harvey |
| 3,934,226 | A | 1/1976 | Stone et al. |
| 5,198,936 | A | 3/1993 | Stringfellow |
| 5,997,149 | A | 12/1999 | Chu |
| 6,032,119 | A | 2/2000 | Brown et al. |
| 6,071,236 | A | 6/2000 | Iliff |
| 6,095,985 | A | 8/2000 | Raymond et al. |
| 6,120,467 | A | 9/2000 | Schallhorn |
| 6,238,337 | B1 | 5/2001 | Kambhatla et al. |
| 6,272,468 | B1 | 8/2001 | Melrose |
| 6,322,502 | B1 | 11/2001 | Schoenberg et al. |
| 6,336,900 | B1 | 1/2002 | Alleckson et al. |
| 6,402,689 | B1 | 6/2002 | Scarantino et al. |
| 6,440,090 | B1 | 8/2002 | Schallhorn |
| 6,454,708 | B1 | 9/2002 | Ferguson et al. |
| 6,468,263 | B1 | 10/2002 | Fischell et al. |
| 6,516,210 | B1 | 2/2003 | Foxall |
| 6,542,204 | B1 | 4/2003 | Ohzawa et al. |
| 6,556,977 | B1 | 4/2003 | Lapointe et al. |
| 6,569,094 | B2 | 5/2003 | Suzuki et al. |
| 6,574,742 | B1 | 6/2003 | Jamroga et al. |
| 6,678,703 | B2 | 1/2004 | Rothschild et al. |
| 6,710,927 | B2 | 3/2004 | Richards |
| 6,725,200 | B1 | 4/2004 | Rost |
| 6,746,122 | B2 | 6/2004 | Knox |

(Continued)

FOREIGN PATENT DOCUMENTS

| | | | |
|---|---|---|---|
| JP | 05181216 | A2 | 7/1993 |

(Continued)

OTHER PUBLICATIONS

Azuma, Ronald; Baillot, Yohan; Behringer, Reinhold; Feiner, Steven; Julier, Simon; MacIntyre, Blair; "Recent Advances in Augmented Reality," pp. 34-47; located at www.cs.unc.edu/~azuma/cga2001.pdf; bearing a date of Nov./Dec. 2001; printed on Jul. 12, 2004.

(Continued)

*Primary Examiner*—Ricardo Osorio

(57) ABSTRACT

Time-lapsing mirror methods and related systems.

24 Claims, 12 Drawing Sheets

U.S. PATENT DOCUMENTS

| | | | | |
|---|---|---|---|---|
| 6,755,539 | B2 | 6/2004 | Brennesholtz | |
| 6,757,087 | B1 | 6/2004 | Taketomi et al. | |
| 6,760,515 | B1 | 7/2004 | Wang et al. | |
| 6,761,458 | B2 | 7/2004 | Sakata et al. | |
| 6,762,870 | B2 | 7/2004 | De Vaan | |
| 6,774,869 | B2 * | 8/2004 | Biocca et al. | 345/8 |
| 2001/0031081 | A1 * | 10/2001 | Quan et al. | 382/154 |
| 2001/0037191 | A1 | 11/2001 | Furuta et al. | |
| 2002/0196333 | A1 * | 12/2002 | Gorischek | 348/61 |
| 2003/0041871 | A1 * | 3/2003 | Endo et al. | 132/301 |
| 2004/0095359 | A1 | 5/2004 | Simon et al. | |
| 2005/0185278 | A1 | 8/2005 | Horsten et al. | |

FOREIGN PATENT DOCUMENTS

| | | | |
|---|---|---|---|
| JP | 06055957 | A2 | 3/1994 |
| WO | WO 02/080773 | A1 | 10/2002 |

OTHER PUBLICATIONS

Butz, Andreas; Beshers, Clifford; Feiner, Steven; "Of Vampire Mirrors and Privacy Lamps: Privacy Management in Multi-User Augmented Environments," pp. 171-172; located at http://www1.cs.columbia.edu/~butz/publications/papers/uist98.pdf; bearing a date of Nov. 2-4, 1998; printed on Jul. 12, 2004.

Francois, Alexandre R.J.; Kang, Elaine; "The Virtual Mirror," pp. 1-5; located at http://iris.usc.edu/~afrancoi/virtual_mirror/; printed on Jul. 12, 2004.

Highbeam Research; "Winntech. (Globalshop 2003 Spotlight);" pp. 1; located at http://www.highbeam.com/library/doc0.asp?docid=1G1:99048681&refid=ink_g5s1&skeyw; printed on Jul. 12, 2004.

Morimoto, Carlos Hitoshi; "Interactive Digital Mirror," from XIV Brazilian Symposium on Computer Graphics and Image Processing (SIBGRAPI'01), Oct. 15-18, 2001; pp. 1; located at http://csdl.computer.org/comp/proceeding/sibgrapi/2001/1330/00/13300232abs.htm; bearing a date of 2001; printed on Jul. 12, 2004.

Riviere, Cameron; Taylor, Russ; Digiola, A.; Wenz, J.; Kostuik, J.; Frassica, F.; "Engineered System Family #3: Information-enhanced Minimally Invasive Surgery," pp. 1-12; located at http://cisstweb.cs.jhu.edu/research/InfoEnhMIS/InfoEnhMISMain.htm; printed on Jul. 12, 2004.

Rochester Institute of Technoloy; "Introduction to Augmented Reality," pp. 1-12; located at http://www.se.rit.edu/~jrv/research/ar/introduction.html; printed on Jul. 12, 2004.

Siggraph Emerging Technologies 1991-2002; "Interactive Paradigm, Technique," pp. 1-5; located at http://www.siggraph.org/~fujii/etech/s_interactive.html; bearing a date of Jul. 5, 2002; printed on Jul. 12, 2004.

Siggraph Emerging Technologies 1991-2002; "Magic Morphin Mirror: Face-Sensitive Distortion and Exaggeration," pp. 1-2; located at http://siggraph.org./~jujii/etech/1997_190.html; bearing a date of Jul. 5, 2002; printed on Jul. 12, 2004.

Spohrer, J.C.; "Information in places," from vol. 38, allegedly of No. 4, 1999, Pervasive Computing; pp. 1-25; located at http://www.research.ibm.com/journal/sj/384/spohrer.html; printed on Jul. 12, 2004.

Traxtal; "What is Augmented Reality," pp. 1-2; located at http://www.traxtal.com/rd/rd_classroom_augmentedreality.htm; printed on Jul. 12, 2004.

Computer Vision & Robotics Laboratory Beckman Institute, "Multiview Mirror Pyramid Panoramic Cameras," Tan, Kar-Han; Hua, Hong; Ahuja, Narendar from the Beckman Institute for Advanced Science and Technology, University of Illionois at Urbana-Champaign, pp. 1-4 located at http://vision.ai.uiuc.edu/~tankh/Camera/camera.html printed on Aug. 9, 2004.

Fulford, Benjamin, "Adventures in the Third Dimension" pp. 1-3 located at www.forbes.com/forbes/2004/0524/166_print.html bearing a date of May 24, 2004 and printed on Sep. 1, 2004.

Healthy Style Products, "Emjoi—The Mirror AP-13," pp. 1-2 located at http://www.healthystyleproducts.com/mirror.html printed on Sep. 1, 2004.

Lin, I-Chen; Yeh, Jeng-Sheng; and Ouhyoung, Ming from National Taiwan University, "Extracting 3D Facial Animation Parameters from Multiview Video Clips," pp. 2-10, bearing a date of Nov./Dec. 2002 and printed on Sep. 1, 2004.

Lin, I-Chen, "The Software Tool of Mass 3D Facial Animation Parameter Extraction from Mirror-Reflected Multi-View Video User's Instruction Version 1.0," located at http://www.cmlab.csie.ntu.edu.tw/~ichen, pp. 1-24 (+ cover sheet), printed on Sep. 1, 2004.

Nextag, "Accessories—compare prices, review and buy a NexTag—Price—Review re Jerdon Mirror,"pp. 1-2 located at http://www.nextag.com/Jerdon_Accessories~2702144zJerdonz0zB36ozmainz5-htm printed on Aug. 9, 2004.

NP Review.Info, "New Product Reviews: New New Product Review—Jerdon JGL9W 5X Magnification Tri-fold Lighted Mirror Product Review," pp. 1-3 located at http://www.npreview.info/Home-and-Garden/Home-Decor/Mirrors/Vanity-Mirrors/Jerdon-JGL9W-5X-Magnification-Tri-fold-Lighted-Mirror.html printed on Sep. 1, 2004.

Sturm, Peter, "Mixing Catadioptric and Perspective Cameras," pp. 1-8, located at http://www.inrialpes.fr/movi/people/Sturm bearing a date of 2002 and printed on Sep. 1, 2004.

Tan, Kar-Han; Hua, Hong, Ahuja, Narenda "Multiview Panoramic Cameras Using Mirror Pyramids," accepted for publication in the IEEE Transactions on Pattern Analysis and Machine Intelligence journal, pp. 1-19 (+ cover sheet), printed on Sep. 1, 2004.

Taniguchi, Rin-Ichiro, "Real-Time Multiview Image Analysis and Its Application," pp. 1-8 printed on Sep. 1, 2004.

The Swiss Technorama Science Center, "Mirrors in Mind: Mirror, Mirror, on the Wall," pp. 1-12, located at http://www.technorama.ch/rentals/description.html printed on Sep. 1, 2004.

Radford, Tim, "Mirror, Mirror on the Wall, Who'll Be Fattest of Them All?", The Guardian Unlimited, bearing a date of Feb. 3, 2005, pp. 1-4, located at http://www.guardian.co.uk/uk_news/story/0,3604,1404636,00.html, printed on Feb. 4, 2005.

PCT International Search Report; International App. No. PCT/US05/27410; Jan. 27, 2006.

PCT International Search Report; International App. No. PCT/US05/27250; May 2, 2006.

PCT International Search Report; International App. No. PCT/US05/27249; Apr. 21, 2006.

PCT International Search Report; International App. No. PCT/US05/27256; Apr. 21, 2006.

* cited by examiner

TIME-LAPSING MIRROR

TECHNICAL FIELD

The present application relates, in general, to mirror technologies.

SUMMARY

In one aspect, a system includes but is not limited to a physical mirror; an image playback device proximate to said physical mirror; and an image registration engine operably couplable to said image playback device. In addition to the foregoing, other system aspects are described in the claims, drawings, and text forming a part of the present application.

In one aspect, a system includes but is not limited to a physical mirror; an image capture device having an image field corresponding to said physical mirror; and at least one image storage device operably couplable with said image capture device. In addition to the foregoing, other system aspects are described in the claims, drawings, and text forming a part of the present application.

In one aspect, a method includes but is not limited to accepting input related to an image in a mirror; and presenting one or more stored images having at least a part of the image in the mirror. In addition to the foregoing, other method aspects are described in the claims, drawings, and text forming a part of the present application.

In one or more various aspects, related systems include but are not limited to circuitry and/or programming for effecting the herein-referenced method aspects; the circuitry and/or programming can be virtually any combination of hardware, software, and/or firmware configured to effect the herein-referenced method aspects depending upon the design choices of the system designer.

In addition to the foregoing, various other method and/or system aspects are set forth and described in the text (e.g., claims and/or detailed description) and/or drawings of the present application.

The foregoing is a summary and thus contains, by necessity, simplifications, generalizations and omissions of detail; consequently, those skilled in the art will appreciate that the summary is illustrative only and is NOT intended to be in any way limiting. Other aspects, inventive features, and advantages of the devices and/or processes described herein, as defined solely by the claims, will become apparent in the detailed description set forth herein.

DETAILED DESCRIPTION

Figure 1:
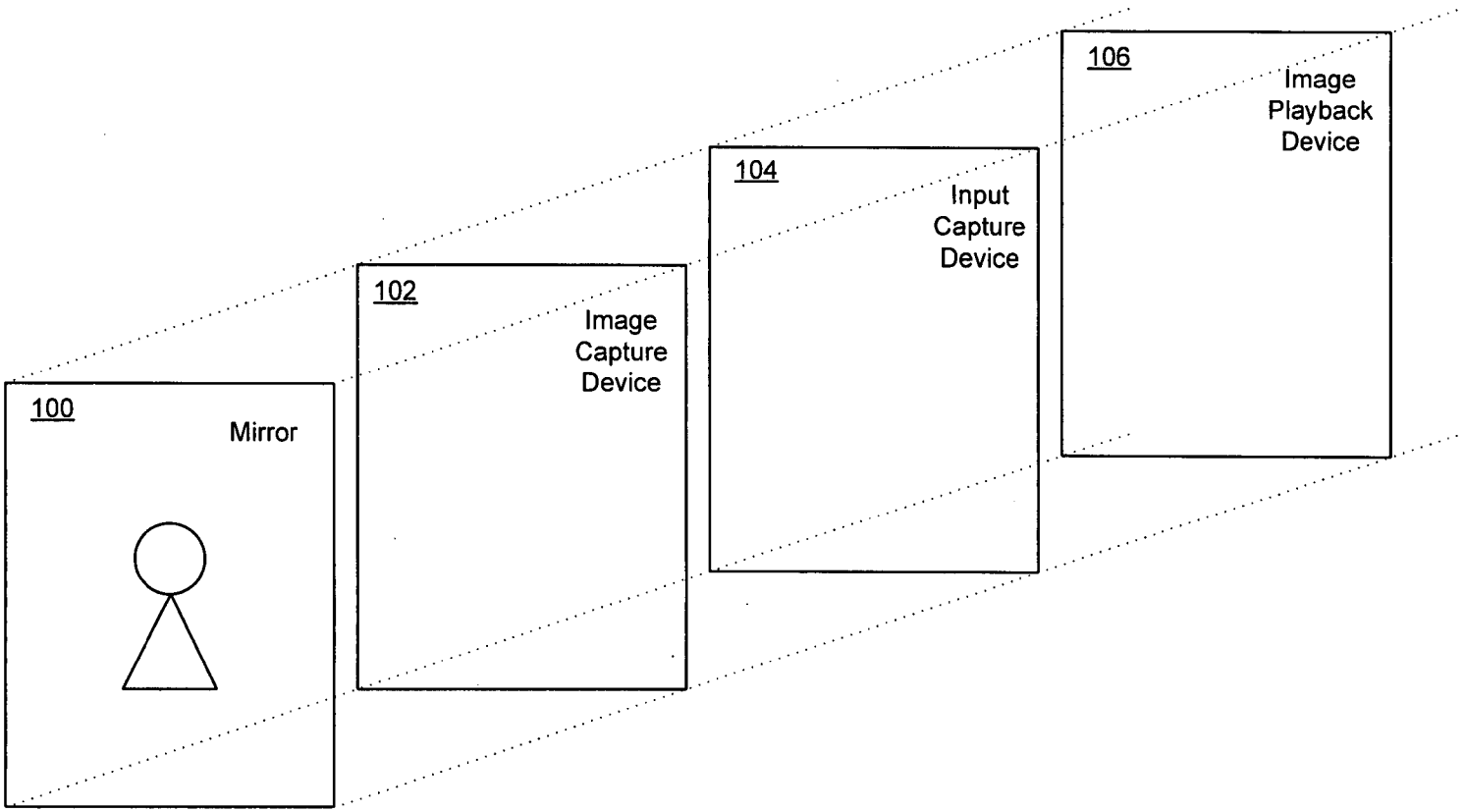
FIG. 1 shows a partial view of a system that may serve as an illustrative environment of and/or for subject matter technologies.

With reference to the figures, and with reference now to FIG. 1, shown is a partial view of a system that may serve as an illustrative environment of and/or for subject matter technologies. Depicted are mirror 100, image capture device 102, input capture device 104, and image playback device 106. In one exemplary implementation, mirror 100 can be a plane mirror, a convex mirror, and/or a concave mirror. Examples of such mirrors may include bathroom, hall, and/or handheld mirrors. In another exemplary implementation, mirror 100 can be a partially silvered mirror. In some exemplary implementations, mirror 100 can be a physical mirror. In other exemplary implementations, mirror 100 can be a digital mirror and/or a projection mirror. In yet other implementations, mirror 100 can be a combination of one or more physical mirrors and/or one or more digital mirrors and/or one or more projection mirrors. In some implementations, image playback device 106 may present various types of time-lapse information in addition or in the alternative to image information, such as height and/or weight information. In some implementations, presentations of information may be in the form of various modalities including but not limited to graphs, tables, audio (speech, music, sound), text, email (e.g. a weekly digest), et cetera.

Continuing to refer to FIG. 1, illustrated is image playback device 106 proximate to mirror 100. One exemplary implementation of image playback device 106 proximate to mirror 100 includes but is not limited to image playback device 106 integral with physical mirror 100. Another exemplary implementation of image playback device 106 proximate to mirror 100 includes but is not limited to image playback device (106) operably coupled with physical mirror 100 (e.g., as used herein, proximate may mean operationally proximate—able to work and interact together either directly or through intermediate components—as well as and/or in addition to physically proximate and/or mechanically proximate). Yet another exemplary implementation of image playback device 106 proximate to mirror 100 includes but is not limited to image playback device 106 in physical communication with physical mirror 100. One exemplary implementation of image playback device 106 in physical communication with physical mirror 100 includes but is not limited to image playback device 106 connected with a frame connected with said physical mirror 100. In some implementations, image playback device 106 can be a light generation device (e.g., a plasma display and/or a liquid crystal display), an image presentation device (e.g., a direct projection to the eye retinal display), and/or a laser device (e.g., a laser diode device).

Figure 2:
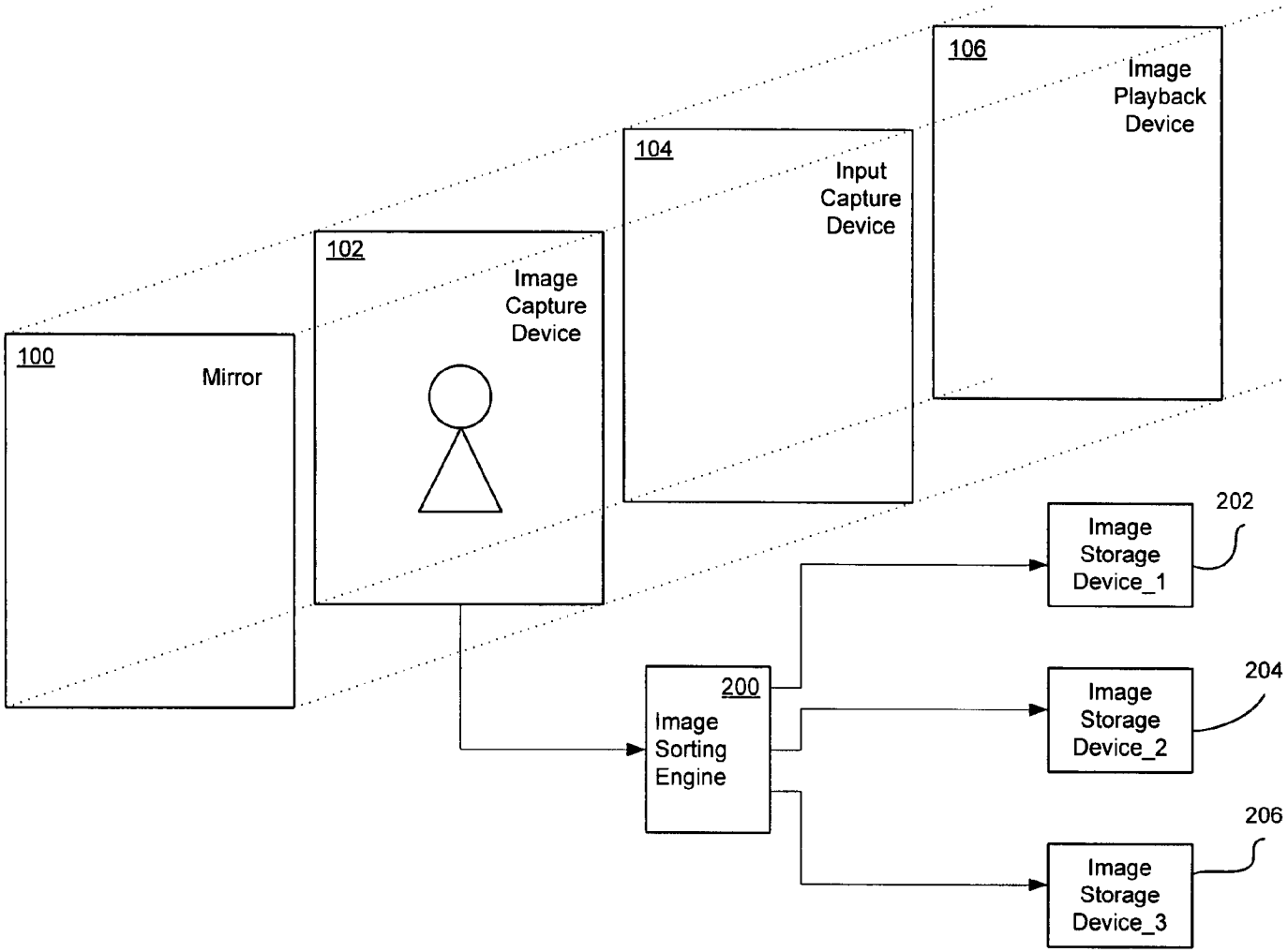
FIG. 2 depicts a partial view of a system that may serve as an illustrative environment of and/or for subject matter technologies.

Referring now to FIG. 2, depicted is a partial view of a system that may serve as an illustrative environment of and/or for subject matter technologies. Illustrated is that image sorting engine 200 interfaces with image capture device 102. Shown is that image sorting engine 200 interfaces with image storage device_1 202, image storage device_2 204, and image storage device_3 206. In one exemplary implementation, image sorting engine 200 receives images from image capture device 102 and sorts the received images into one or more of image storage device_1 202, image storage device_2 204, and image storage device_3 206 based on pattern recognition algorithms. For example, in an implementation where image capture device 102 is capturing three-dimensional (3-D) images of a human subject, image sorting engine 200 may utilize 3-D image processing routines to sort various recognized captured images into image storage device_1 202, image storage device_2 204, and image storage device_3 206 (e.g., where images of a first person are sorted to image storage device_1 202, images of a second person are sorted to image storage device_2 204, and images of a third person are sorted to image storage device_3 206). Those skilled in the art will appreciate that, as used herein, sorting can include categorization, ordering, and/or other operations such as those described herein.

Continuing to refer to FIG. 2, in one implementation, image capture device 102 can include at least one image representation device located to capture a field of view of mirror 100. For example, an active photo-detector array completely and/or partially in identity with a display portion of mirror 100 or a lensed image capture system oriented such that it could capture all or part of an image reflected from mirror 100. In another exemplary implementation, image capture device 102 can include at least two image representation devices located to capture a field of view of mirror 100. For example, two or more camera systems positioned to capture stereo imagery such that 3-D imaging techniques may be applied. The image capture devices described herein can be positioned substantially anywhere an image of mirror 100 can be captured, such as behind mirror 100 in order to catch transmitted images through a partially silvered mirror, to the sides and/or above and/or below a mirror, and/or positioned and/or oriented to the front of a mirror in order to record images reflected from a mirror. In some implementations, the image capture devices may also be positioned such that they reside behind where a user would be expected to stand when viewing mirror 100.

Figure 3:
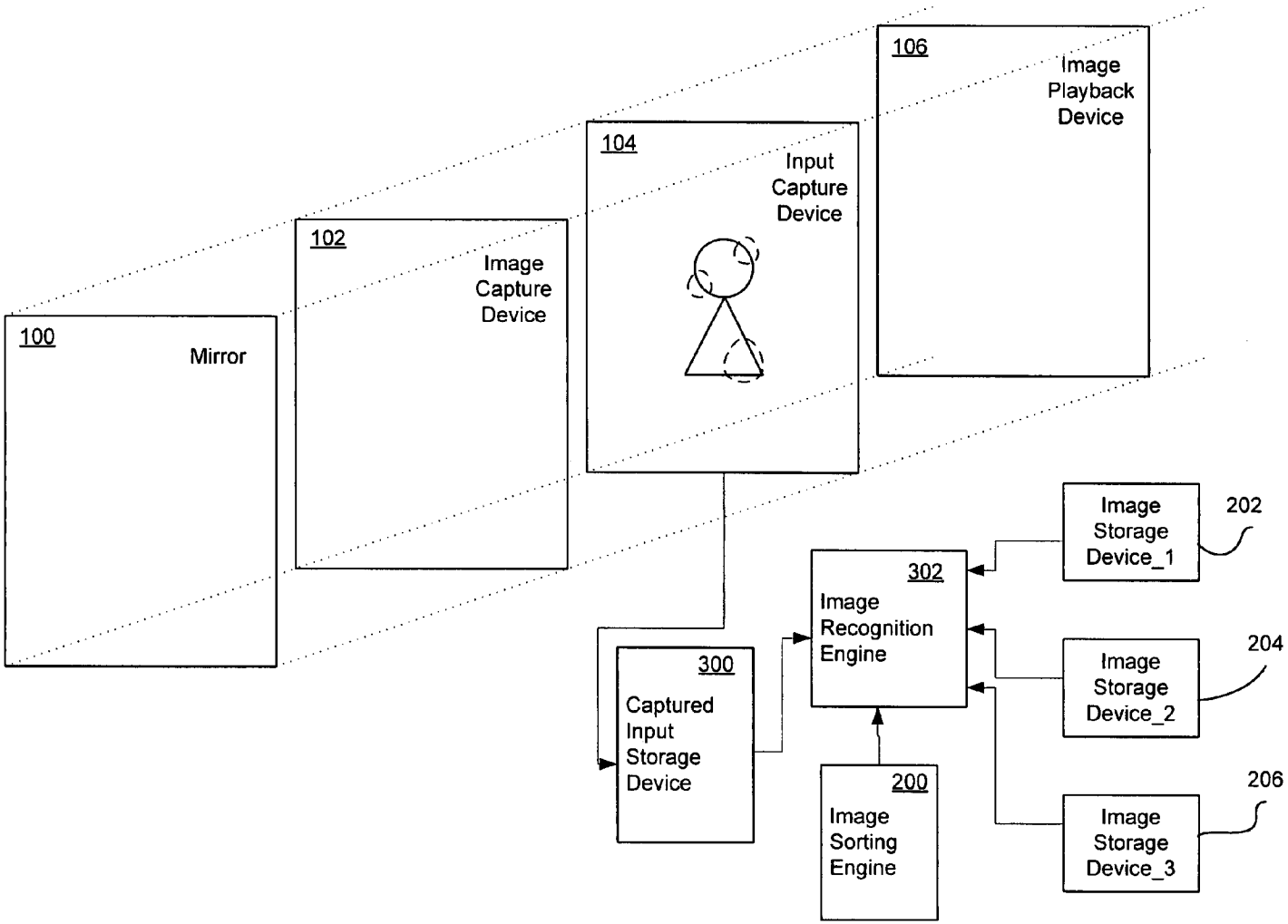
FIG. 3 illustrates a partial view of a system that may serve as an illustrative environment of and/or for subject matter technologies.

With reference now to FIG. 3, illustrated is a partial view of a system that may serve as an illustrative environment of and/or for subject matter technologies. Shown is captured input storage device 300 exchanging signals with input capture device 104. Depicted is image recognition engine 302 exchanging signals with captured input storage device 300, image sorting engine 200, image storage device_1 202, image storage device_2 204, and image storage device_3 206. In one exemplary implementation, a user (e.g., a human user) touches and/or circles a region of an image in mirror 100 and asks that the system show a time-lapse presentation of the region over some interval of time. For example, a human user touching a skin lesion on his/her image and asking that the system show the mole over the last three months. In response, in one implementation captured input storage device 300 captures both the region of the image touched as well as the request for the time-lapse presentation of the mole (in some implementations, the request is typed such as via touch screen entry to a menu driven system, while in other implementations, the request is spoken such as via voice recognition input driven system). Thereafter, in one implementation, image recognition engine 302 interacts with image sorting engine 200 to determine where images associated with the person whose input has been captured are stored. For example, if the person in the mirror's previously captured images had been stored in image storage device_3 206, then image sorting engine 200 would inform image recognition engine 302 of that fact. Thereafter, image recognition engine 302 would know the storage location of that person's image.

Figure 4:
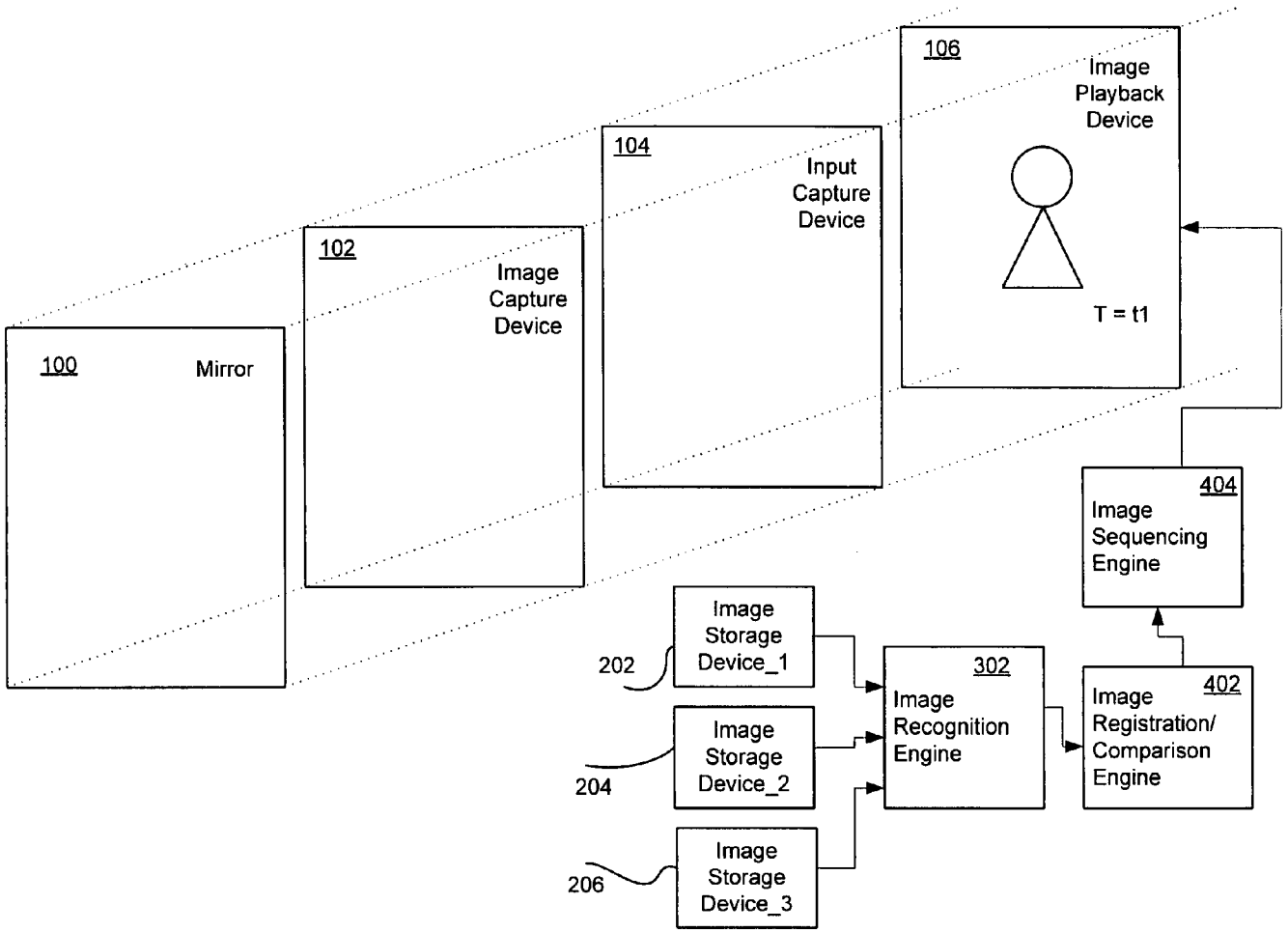
FIG. 4 shows a partial view of a system that may serve as an illustrative environment of and/or for subject matter technologies.

Referring now to FIG. 4, shown is a partial view of a system that may serve as an illustrative environment of and/or for subject matter technologies. Depicted is image recognition engine 302 interfaced with image sorting engine 200, image storage device_1 202, image storage device_2 204, and image storage device_3 206. Illustrated is image recognition engine 302 interfaced with image registration/comparison engine 402. Shown is image registration/comparison engine 402 interfaced with image sequencing engine 404. In one exemplary implementation, image recognition engine 302 retrieves time-sequenced images from one or more of image storage device_1 202, image storage device_2 204, and image storage device_3 206. Thereafter, image registration/comparison engine 402 uses some relatively stable image feature(s), such as anatomical landmarks (e.g., bony regions or a center part of some defined anatomical feature), to encompass and or localize a region of interest where some feature of interest resides, to provide proper alignment. Image sequencing engine 404 then presents the aligned images in a time sequenced fashion such that the changes in the region of interest can be viewed over time. For instance, a time-lapse presentation of how a mole has grown over the last few months.

In some implementations, instead of or as an addition to the foregoing, image registration/comparison engine 402 compares a specified feature (e.g., hair length or jowl size) against a reference value and presents information (e.g., an alert) when the specified feature exceeds the reference value by some defined amount. As a specific example, a user might instruct the system to alert her if her hair has grown more than 8 millimeters beyond some reference length. If her hair did exceed the threshold beyond the reference length, the system would present a display indicating that event, and perhaps suggesting that a haircut was needed.

Figure 5:
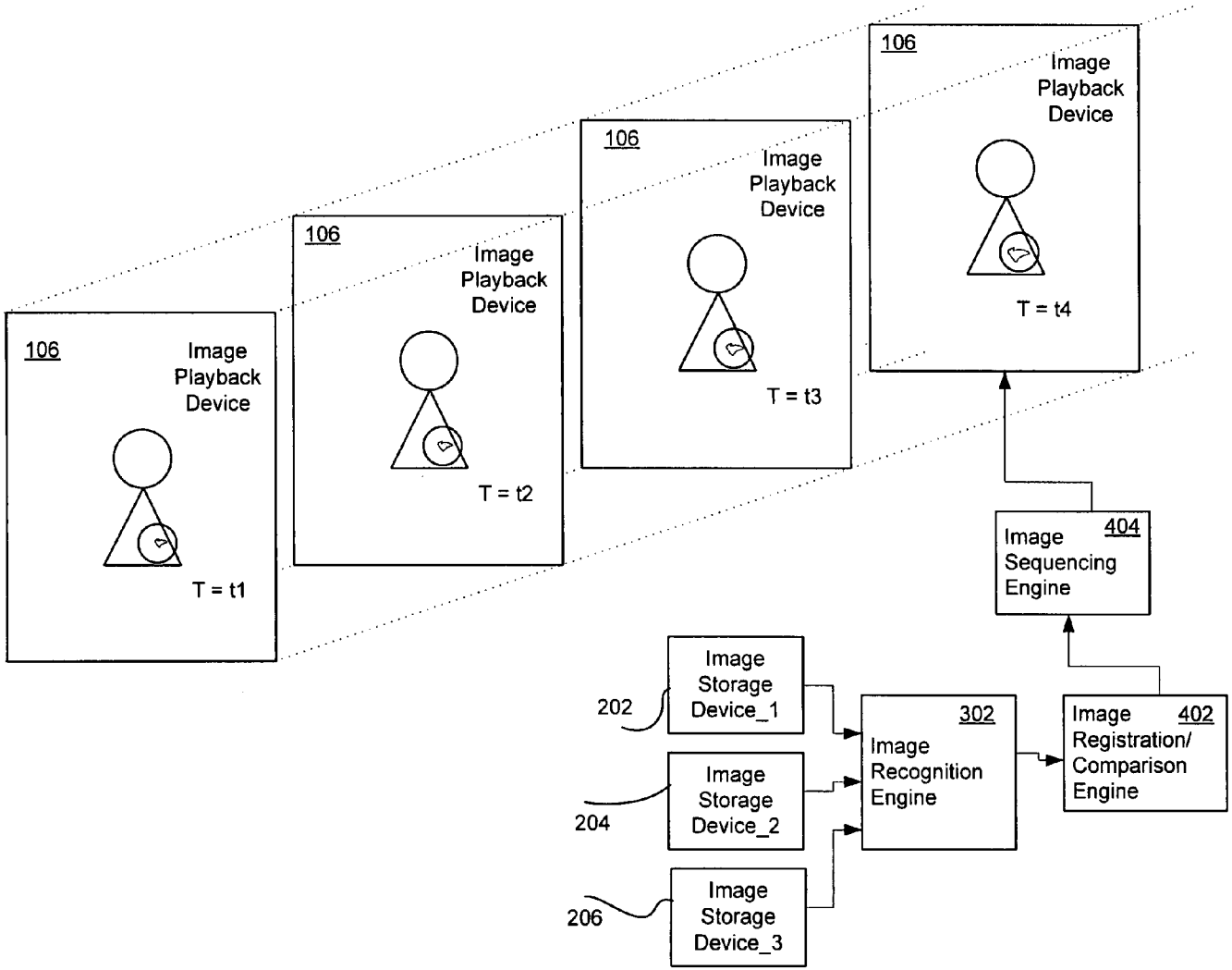
FIG. 5 depicts a partial view of a system that may serve as an illustrative environment of and/or for subject matter technologies.

With reference now to FIG. 5, depicted is a partial view of a system that may serve as an illustrative environment of and/or for subject matter technologies. Illustrated is the system presenting four (4) time sequenced views showing the growth of lesion within a skin region over time. Depicted is that the lesion is dark with an irregular border and growing, such as, for example, a melanoma region. Other things could be like depicted, like hair length, jowl size, etc.

Following are a series of flowcharts depicting implementations of processes. For ease of understanding, the flowcharts are organized such that the initial flowcharts present implementations via an overall "big picture" viewpoint and thereafter the following flowcharts present alternate implementations and/or expansions of the "big picture" flowcharts as either sub-steps or additional steps building on one or more earlier-presented flowcharts. Those having skill in the art will appreciate that the style of presentation utilized herein (e.g., beginning with a presentation of a flowchart(s) presenting an overall view and thereafter providing additions to and/or further details in subsequent flowcharts)

generally allows for a rapid and easy understanding of the various process implementations.

Figure 6:
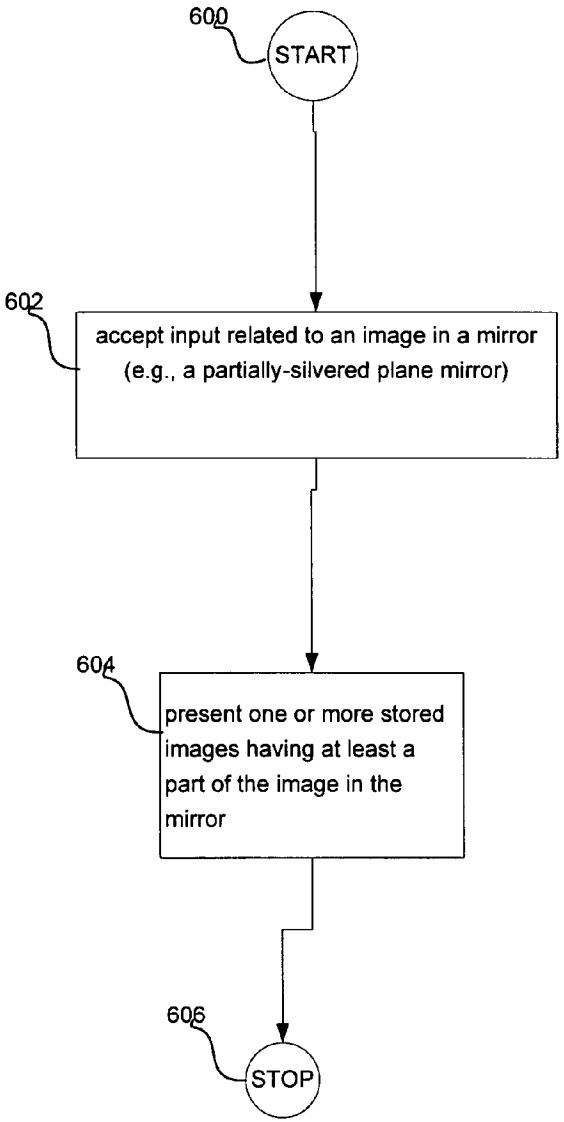
FIG. 6 illustrates a high-level logic flowchart of a process.

Referring now to FIG. 6, illustrated is a high-level logic flowchart of a process. Method step 600 shows the start of the process. Method step 602 shows accepting input related to an image in a mirror (e.g., via captured input storage device 300 and/or its supporting components). Method step 604 depicts presenting one or more stored images having at least a part of the image in the mirror (e.g., such as shown/described in relation to FIG. 5). Method step 606 shows the end of the process. Those skilled in the art will appreciate that, in some implementations, the "at least a part of the image" can include but is not limited to a recognized region of an image or a recognized anchor point associated with an image which will provide the ability to do presentation on regions that both are and are not readily visually coordinated with an original field of view of a mirror. For example, in a hand-held mirror implementation, a user might zoom in on a region of an image and then ask to see a time-lapse sequence of images representative of changes in that zoomed-in region, such that the zoomed-in region is not readily visually coordinated with the original unzoomed field of view of the mirror. The inventors point out that those skilled in the art will appreciate that while the zoomed-in region might not be easily visually coordinated with the un-zoomed field of view, in some implementations the use of anchor points will allow coordination between the zoomed and unzoomed views. In addition, the inventors further point out that while examples set forth herein focus on anatomy and/or anatomical change for sake of clarity, the systems described herein can actually track and/or show a time lapse of substantially any object that may be reflected in the mirror.

Figure 7:
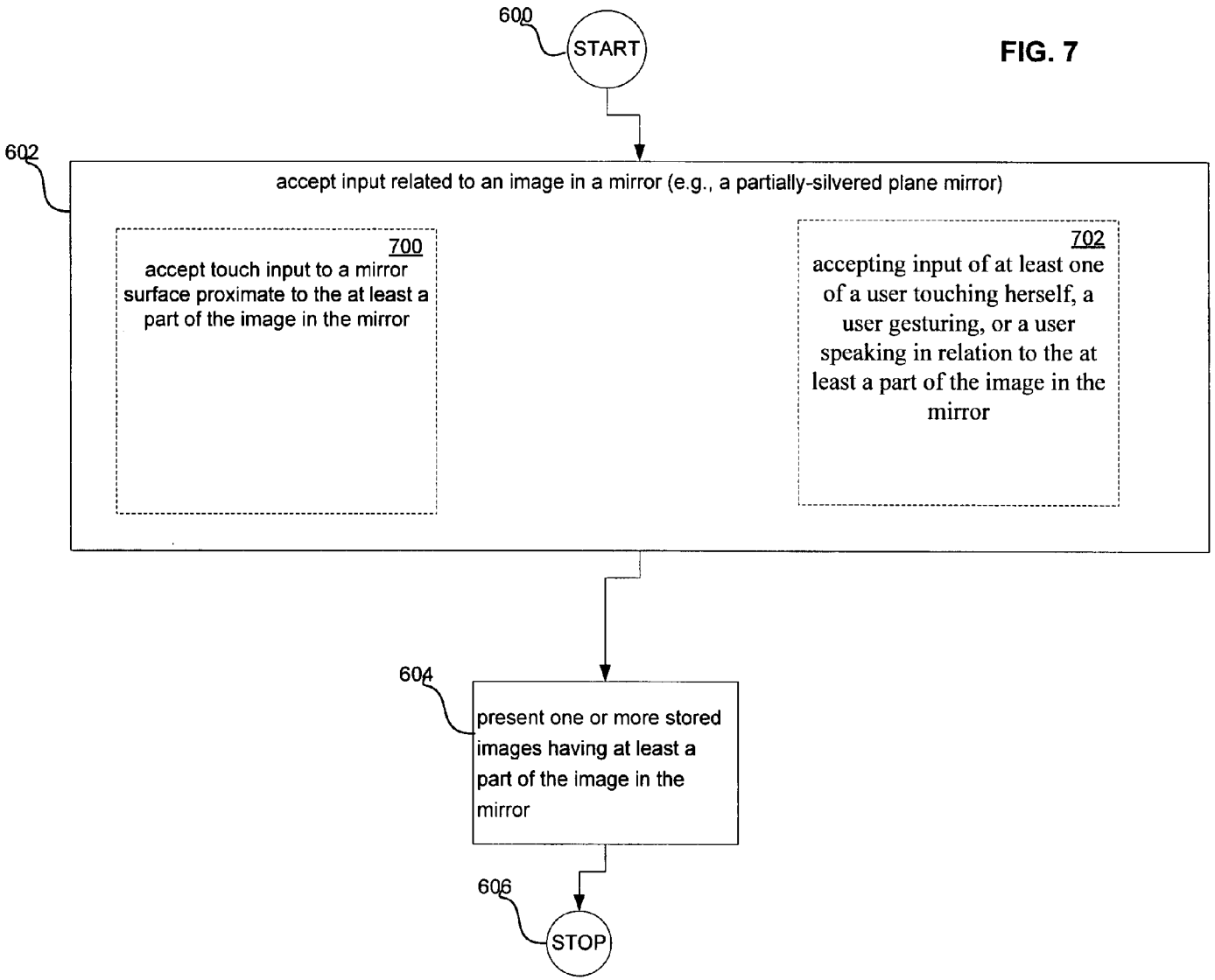
FIG. 7 shows a high-level logic flowchart depicting alternate implementations of the high-level logic flowchart of FIG. 6.

With reference now to FIG. 7, shown is a high-level logic flowchart depicting alternate implementations of the high-level logic flowchart of FIG. 6. Depicted is that in various alternate implementations, method step 602 includes method step 700 and/or method step 702. Method step 700 shows accepting touch input to a mirror surface proximate to the at least a part of the image in the mirror (e.g., via input capture device 104 capturing input when a user's finger is proximate to an image in mirror 100) Method step 702 depicts accepting input of at least one of a user touching herself, a user gesturing, or a user speaking in relation to the at least a part of the image in the mirror (e.g., via input capture device 104 capturing input when a user's gestures or pointing relative to at least a part of an image in mirror 100 and/or the user speaking a command in relation to at least a part of an image in mirror 100).

Figure 8:
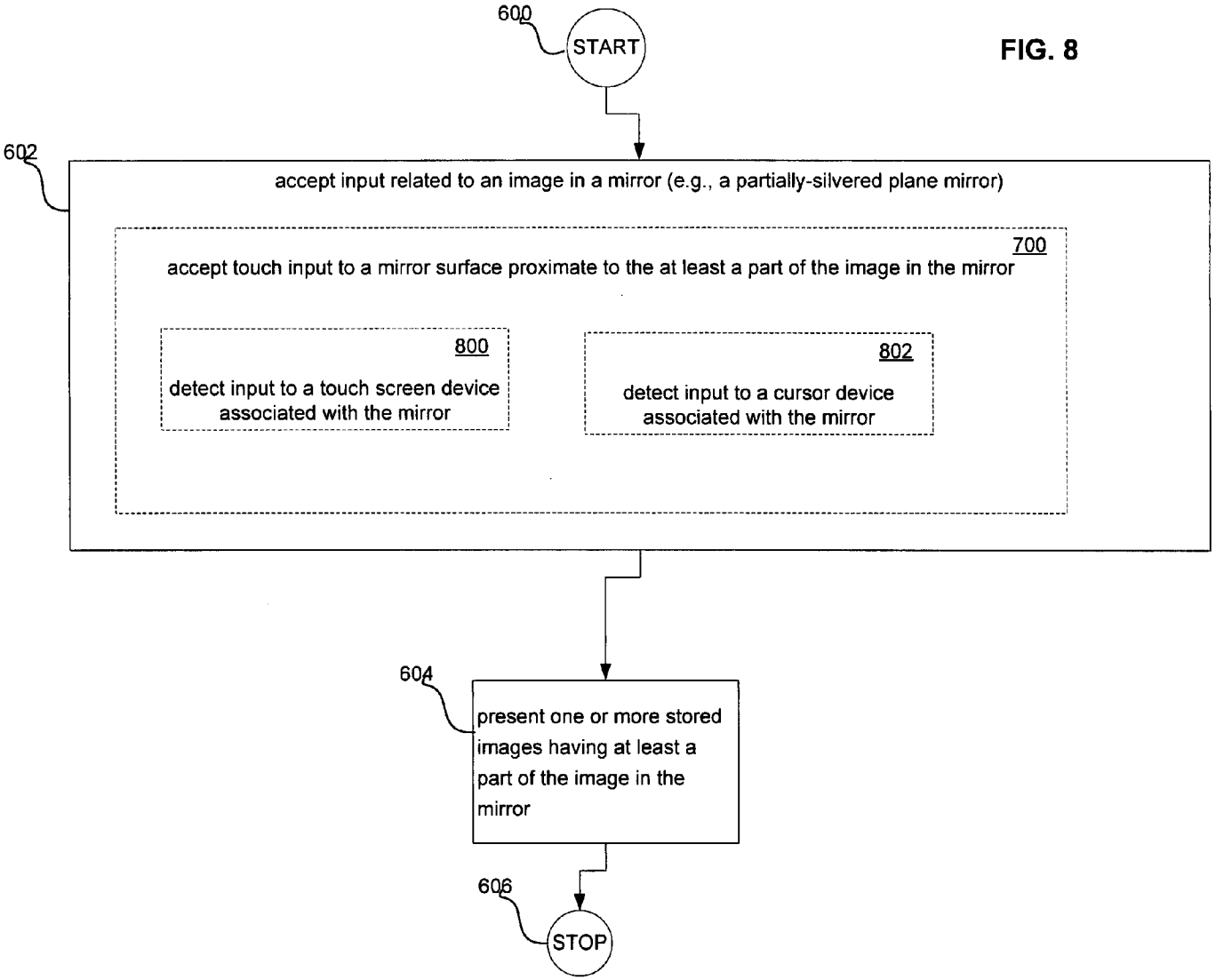
FIG. 8 depicts a high-level logic flowchart depicting alternate implementations of the high-level logic flowchart of FIG. 7.

Referring now to FIG. 8, depicted is a high-level logic flowchart depicting alternate implementations of the high-level logic flowchart of FIG. 7. Depicted is that in one alternate implementation, method step 700 includes method step 800 and/or method step 802. Method step 800 shows detecting input to a touch screen device associated with the mirror (e.g. via mirror 100 and/or input capture device 104 and/or one or more of their supporting components). Method step 802 depicts detecting input to a cursor device associated with the mirror (e.g. via mirror 100 and/or input capture device 104 and/or one or more of their supporting components).

Figure 9:
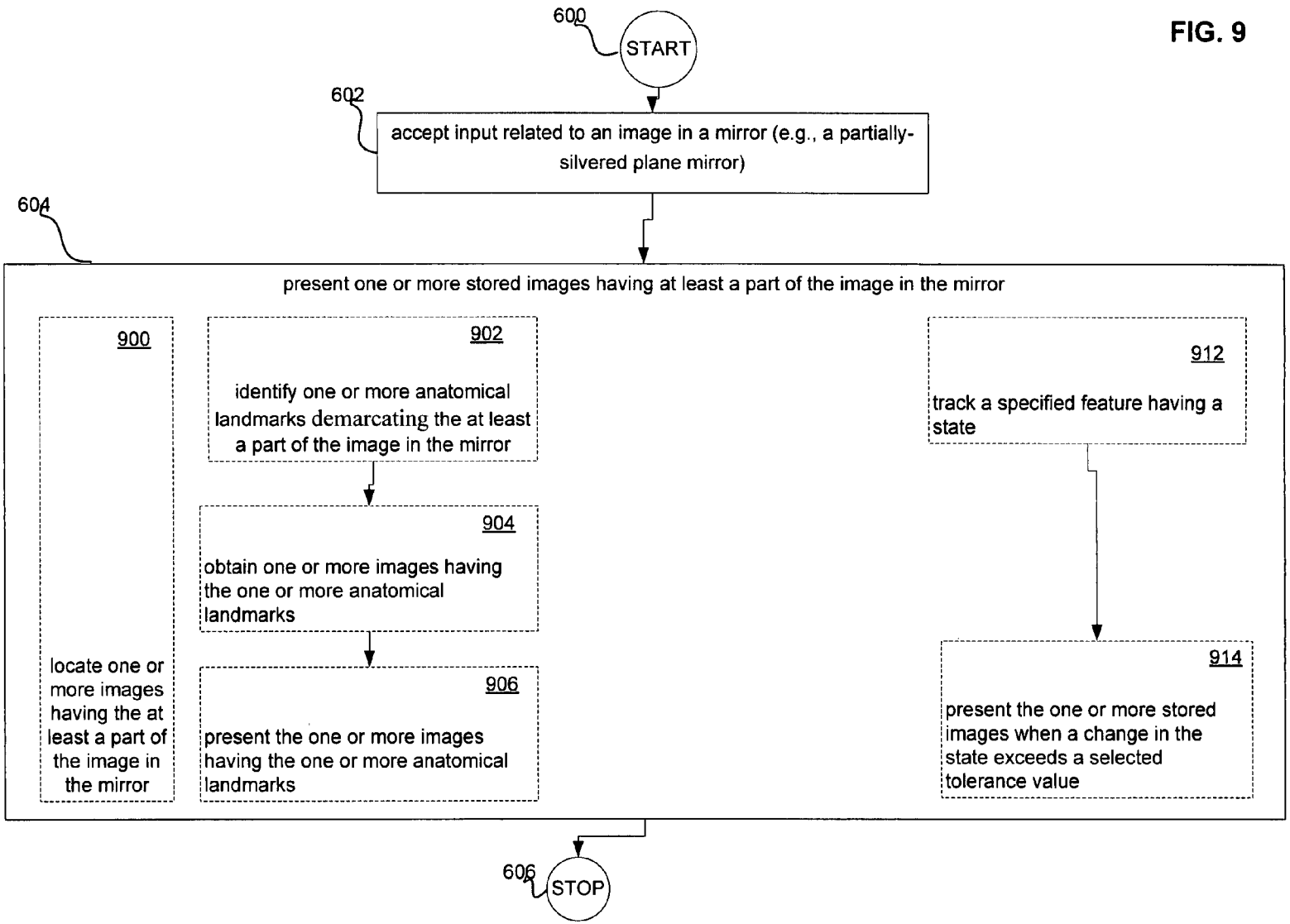
FIG. 9 illustrates a high-level logic flowchart depicting alternate implementations of the high-level logic flowchart of FIG. 6.

With reference now to FIG. 9, illustrated is a high-level logic flowchart depicting alternate implementations of the high-level logic flowchart of FIG. 6. Depicted is that in various alternate implementations, method step 604 includes method step 900, and/or method steps 902–906, and/or method steps 912–914. Method step 900 shows one alternate implementation of locating one or more images having the at least a part of the image in the mirror. For example, locating the one or more images via image sorting engine 200, captured input storage device 300, image recognition engine 302, and/or one or more of image storage devices 202–206.

Continuing to refer to FIG. 9, method steps 902–906 depict another alternate embodiment. Method step 902 illustrates identifying one or more anatomical landmarks demarcating the at least a part of the image in the mirror (e.g., via image sorting engine 200 and/or image recognition engine 302). Method step 904 shows obtaining one or more images having the one or more anatomical landmarks (e.g., via image recognition engine 302 and/or image registration/comparison engine 402). Method step 906 depicts presenting the one or more images having the one or more anatomical landmarks (e.g., via image playback device 106 and/or image sequencing engine 404).

Continuing to refer to FIG. 9, method steps 912–914 illustrate yet another alternate embodiment. Method step 912 shows tracking a specified feature having a state (e.g., via image registration/comparison engine 402 and/or its supporting components). Method step 914 depicts presenting the one or more stored images when a change in the state exceeds a selected tolerance value (e.g., via image registration/comparison engine 402 and/or image sequencing engine 404 and/or their supporting components).

Figure 10:
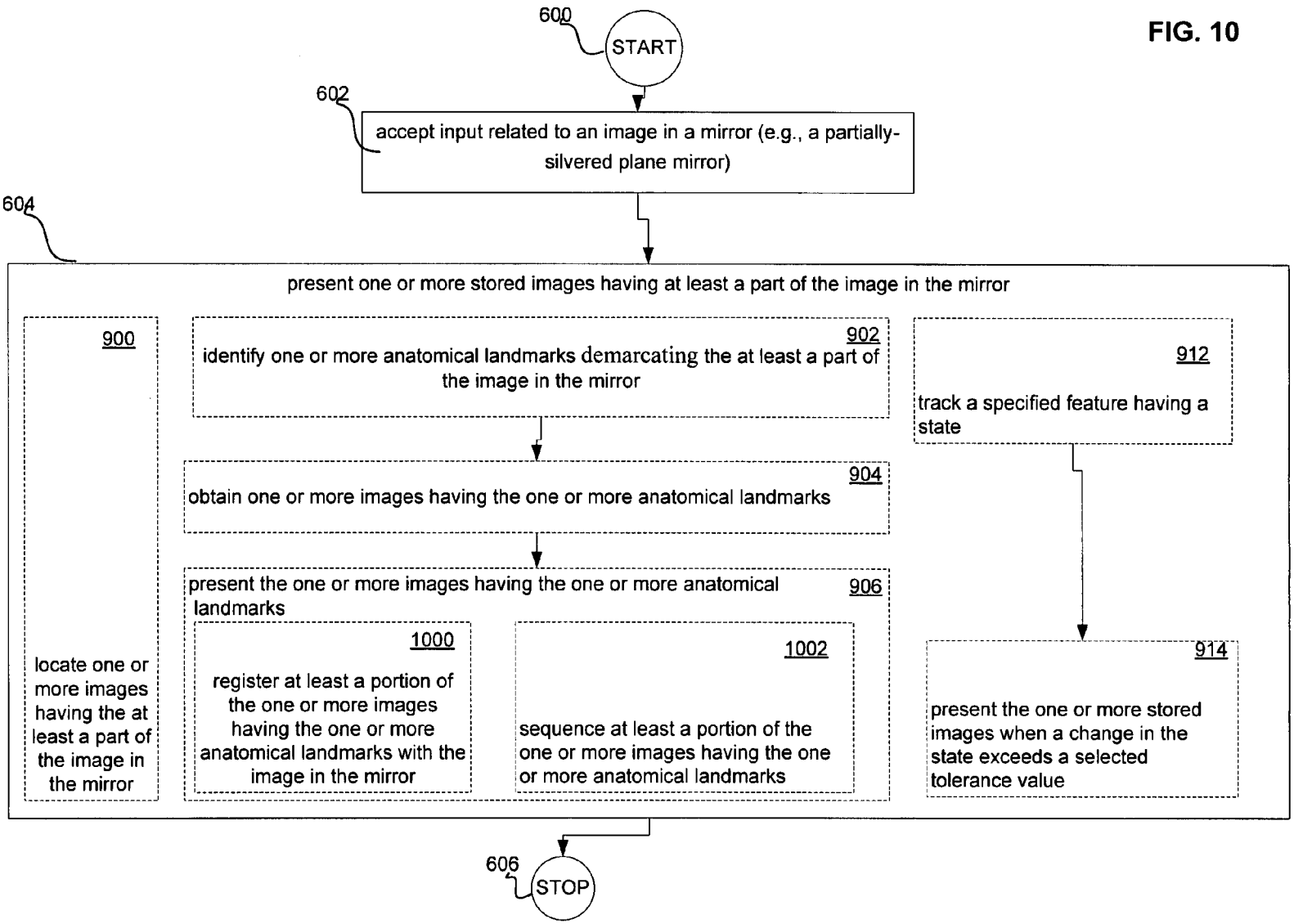
FIG. 10 shows a high-level logic flowchart depicting alternate implementations of the high-level logic flowchart of FIG. 9.

Referring now to FIG. 10, shown is a high-level logic flowchart depicting alternate implementations of the high-level logic flowchart of FIG. 9. Depicted is that in various alternate implementations, method step 906 includes method step 1000 and/or method step 1002. Method step 1000 illustrates registering at least a portion of the one or more images having the one or more anatomical landmarks with the image in the mirror (e.g., via image registration/comparison engine 402). Method step 1002 shows sequencing at least a portion of the one or more images having the one or more anatomical landmarks (e.g., via image sequencing engine 404).

Figure 11:
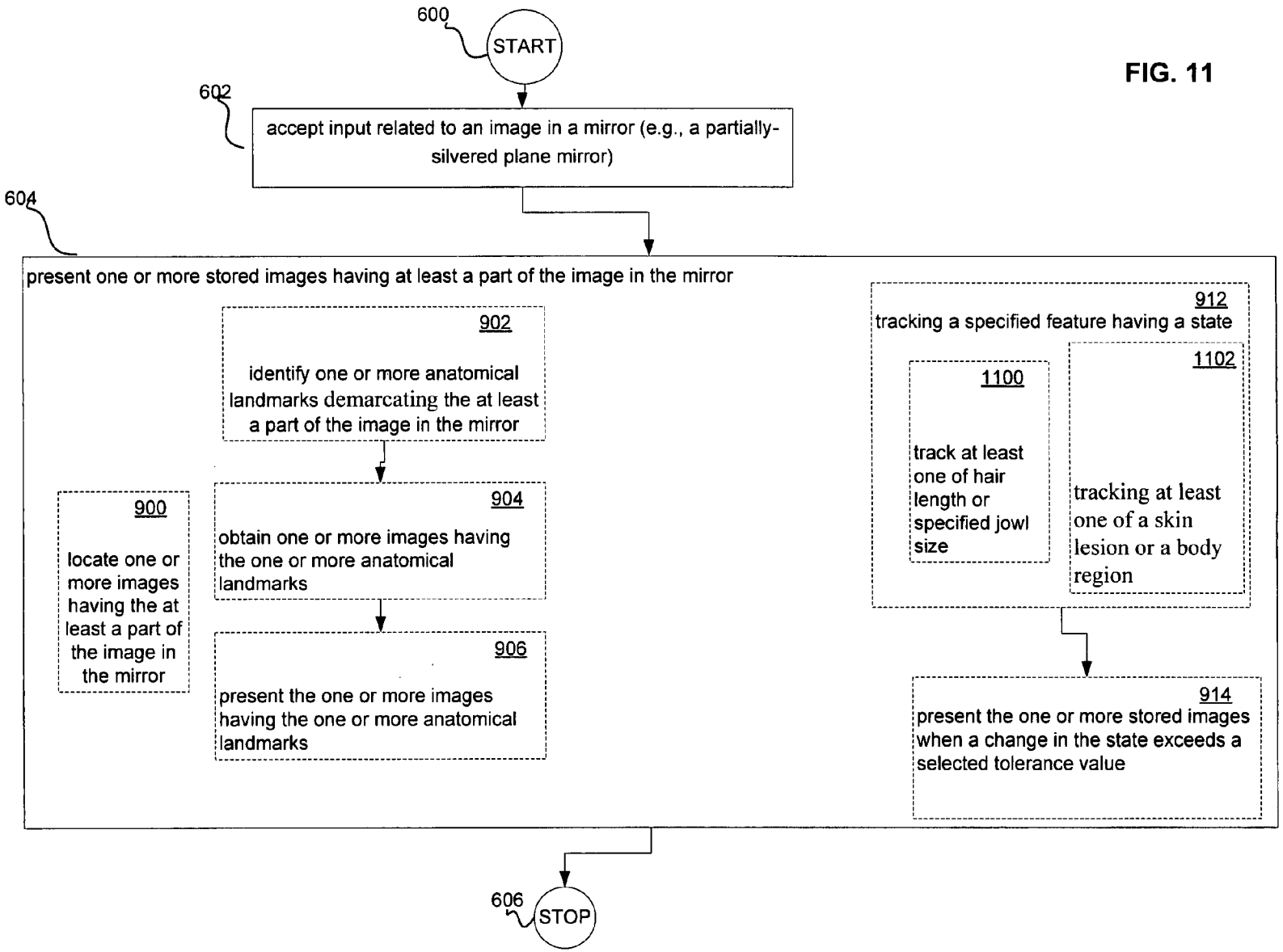
FIG. 11 depicts a high-level logic flowchart depicting alternate implementations of the high-level logic flowchart of FIG. 9.

With reference now to FIG. 11, depicted is a high-level logic flowchart depicting alternate implementations of the high-level logic flowchart of FIG. 9. Illustrated is that in various alternate implementations, method step 912 includes method step 1100 and/or method step 1102. Method step 1100 illustrates tracking at least one of hair length or jowl size (e.g., via image registration/comparison engine 402 and/or its supporting components). Method step 1102 shows tracking at least one of a skin lesion or a body region (e.g., via image recognition engine 302 and/or image registration/comparison engine 402 and/or their supporting components), which the inventors point out is helpful in a handheld mirror implementation.

Figure 12:
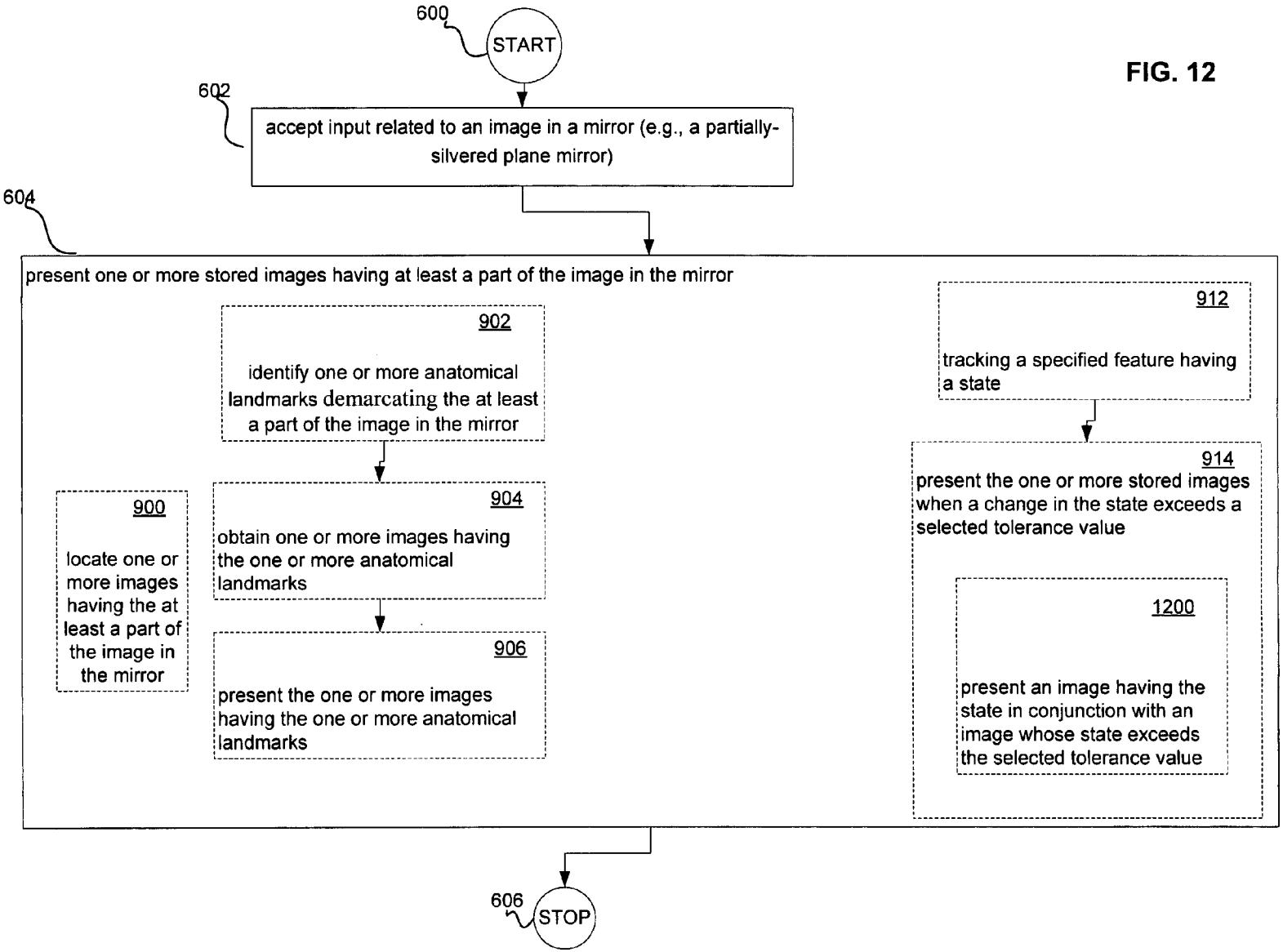
FIG. 12 illustrates a high-level logic flowchart depicting an alternate implementation of the high-level logic flowchart of FIG. 9. The use of the same symbols in different drawings typically indicates similar or identical items.

Referring now to FIG. 12, illustrated is a high-level logic flowchart depicting an alternate implementation of the high-level logic flowchart of FIG. 9. Shown is that in one alternate implementation, method step 914 includes method step 1200. Method step 1200 shows presenting an image having the state in conjunction with an image whose state exceeds the selected tolerance value (e.g., via image recognition engine 302 and/or image registration/comparison engine 402 and/or image sequencing engine 404 and/or their supporting components).

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

Those having skill in the art will recognize that the state of the art has progressed to the point where there is little distinction left between hardware and software implementations of aspects of systems; the use of hardware or software is generally (but not always, in that in certain contexts the choice between hardware and software can become significant) a design choice representing cost vs. efficiency tradeoffs. Those having skill in the art will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations will employ optically-oriented hardware, software, and or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in standard integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter subject matter described herein are capable of being distributed as a program product in a variety of forms, and that an illustrative embodiment of the subject matter subject matter described herein applies regardless of the particular type of signal bearing media used to actually carry out the distribution. Examples of a signal bearing media include, but are not limited to, the following: recordable type media such as floppy disks, hard disk drives, CD ROMs, digital tape, and computer memory; and transmission type media such as digital and analog communication links using TDM or IP based communication links (e.g., packet links).

In a general sense, those skilled in the art will recognize that the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment).

Those skilled in the art will recognize that it is common within the art to describe devices and/or processes in the fashion set forth herein, and thereafter use standard engineering practices to integrate such described devices and/or processes into image processing systems. That is, at least a portion of the devices and/or processes described herein can be integrated into an image processing system via a reasonable amount of experimentation. Those having skill in the art will recognize that a typical image processing system generally includes one or more of a system unit housing, a video display device, a memory such as volatile and non-volatile memory, processors such as microprocessors and digital signal processors, computational entities such as operating systems, drivers, and applications programs, one or more interaction devices, such as a touch pad or screen, control systems including feedback loops and control motors (e.g., feedback for sensing lens position and/or velocity; control motors for moving/distorting lenses to give desired focuses. A typical image processing system may be implemented utilizing any suitable commercially available components, such as those typically found in digital still systems and/or digital motion systems.

All of the above U.S. patents, U.S. patent application publications, U.S. patent applications, foreign patents, foreign patent applications, and non-patent publications referred to in this specification and/or listed in any Application Data Sheet are incorporated herein by reference, in their entireties.

The foregoing described aspects depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular aspects of the present subject matter described herein have been shown and described, it will be apparent to those skilled in the art that, based upon the teachings herein, changes and modifications may be made without departing from this subject matter described herein and its broader aspects and, therefore, the appended claims are to encompass within their scope all such changes and modifications as are within the true spirit and scope of this subject matter described herein. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.).

The invention claimed is:

1. A method comprising:

accepting input related to an image in a mirror; and presenting one or more stored images having at least a part of the image in the mirror, wherein said presenting the one or more stored images having the at least the part of the image in the mirror further includes:

identifying one or more anatomical landmarks demarcating the at least the part of the image in the mirror;

obtaining one or more images having the one or more anatomical landmarks; and presenting the one or more images having the one or more anatomical landmarks, wherein said presenting the one or more images having the one or more anatomical landmarks further includes:

registering at least a portion of the one or more images having the one or more anatomical landmarks of the image in the mirror.

2. The method of claim 1, wherein said accepting input related to an image in a mirror further comprises:

accepting touch input to a mirror surface proximate to the at least the part of the image in the mirror.

3. The method of claim 2, wherein said accepting touch input to a mirror surface proximate to the at least the part of the image in the mirror further comprises:

detecting input to a touch screen device associated with the mirror.

4. The method of claim 2, wherein said accepting touch input to a mirror surface proximate to the at least the part of the image in the mirror further comprises:

detecting input to a cursor device associated with the mirror.

5. The method of claim 1, wherein said accepting input related to an image in a mirror further comprises:

accepting input of at least one of a user touching herself, a user gesturing, or a user speaking in relation to the at least the part of the image in the mirror.

6. The method of claim 1, wherein the at least a part of the image in the mirror further comprises:

at least one of a recognized region of the image or a recognized anchor point associated with the image.

7. The method of claim 1, wherein said presenting one or more stored images having at least a part of the image in the mirror further comprises:

locating one or more images having the at least the part of the image in the mirror.

8. The method of claim 1, wherein said presenting the one or more images having the one or more anatomical landmarks further comprises:

sequencing the at least the portion of the one or more images having the one or more anatomical landmarks.

9. The method of claim 1, wherein said presenting one or more stored images having at least a part of the image in the mirror further comprises:

tracking a specified feature having a state; and presenting the one or more stored images when a change in the state exceeds a selected tolerance value.

10. The method of claim 9, wherein said tracking a specified feature having a state further comprises:

tracking at least one of hair length or jowl size.

11. The method of claim 9, wherein said tracking a specified feature having a state further comprises:

tracking at least one of a skin lesion or a body region.

12. The method of claim 9, wherein said presenting the one or more stored images when a change in the state exceeds a selected tolerance value further comprises:

presenting an image having the state in conjunction with an image whose state exceeds the selected tolerance value.

13. A system comprising:

means for accepting input related to an image in a mirror; and means for presenting one or more stored images having at least a part of the image in the mirrors, wherein said means for presenting the one or more stored images having the at least the part of the image in the mirror further includes:

means for identifying one or more anatomical landmarks demarcating the at least the part of the image in the mirror;

means for obtaining one or more images having the one or more anatomical landmarks; and means for presenting the one or more images having the one or more anatomical landmarks, wherein said means for presenting the one or more images having the one or more anatomical landmarks includes:

means for registering at least a portion of the one or more images having the one or more anatomical landmarks of the image in the mirror.

14. The system of claim 13, wherein said means for accepting input related to an image in a mirror further comprises:

means for accepting touch input to a mirror surface proximate to the at least the part of the image in the mirror.

15. The system of claim 14, wherein said means for accepting touch input to a mirror surface proximate to the at least the part of the image in the mirror further comprises:

means for detecting input to a touch screen device associated with the mirror.

16. The system of claim 14, wherein said means for accepting touch input to a mirror surface proximate to the at least the part of the image in the mirror further comprises:

means for detecting input to a cursor device associated with the mirror.

17. The system of claim 13, wherein said means for accepting input related to an image in a mirror further comprises:

means for accepting input of at least one of a user touching herself, a user gesturing, or a user speaking in relation to the at least the part of the image in the mirror.

18. The system of claim 13, wherein said means for presenting one or more stored images having at least a part of the image in the mirror further comprises:

means for locating the one or more images having the at least the part of the image in the mirror.

19. The system of claim 13 wherein said means for presenting the one or more images having the one or more anatomical landmarks further comprises:

means for sequencing the at least the portion of the one or more images having the one or more anatomical landmarks.

20. The system of claim 13, wherein said means for presenting one or more stored images having at least a part of the image in the mirror further comprises:

means for tracking a specified feature having a state; and means for presenting the one or more stored images when a change in the state exceeds a selected tolerance value.

21. The system of claim 20, wherein said means for tracking a specified feature having a state further comprises:

means for tracking at least one of hair length or jowl size.

22. The system of claim 20, wherein said means for tracking a specified feature having a state further comprises:

means for tracking at least one of a skin lesion or a body region.

23. The system of claim 20, wherein said means for presenting the one or more stored images when a change in the state exceeds a selected tolerance value further comprises:

means for presenting an image having the state in conjunction with an image whose state exceeds the selected tolerance value.

24. The system of claim 13, wherein the at least a part of the image in the mirror further comprises:

at least one of a recognized region of the image or a recognized anchor point associated with the image.

* * * * *

UNITED STATES PATENT AND TRADEMARK OFFICE

CERTIFICATE OF CORRECTION

PATENT NO. : 7,283,106 B2
APPLICATION NO. : 10/910421
DATED : October 16, 2007
INVENTOR(S) : Paul G. Allen et al.

It is certified that error appears in the above-identified patent and that said Letters Patent is hereby corrected as shown below:

Column 10, line 67, claim 13: "image in the mirrors," should read --image in the mirror,--

Signed and Sealed this
Ninth Day of April, 2013

Teresa Stanek Rea
*Acting Director of the United States Patent and Trademark Office*